US010053751B2

(12) United States Patent
Aruga

(10) Patent No.: US 10,053,751 B2
(45) Date of Patent: Aug. 21, 2018

(54) COPPER ALLOY SHEET EXCELLENT IN RESISTANCE PROPERTY OF STRESS RELAXATION

(75) Inventor: Yasuhiro Aruga, Kobe-shi (JP)

(73) Assignee: Kobe Steel, Ltd., Kobe-shi (JP)

( * ) Notice: Subject to any disclaimer, the term of this patent is extended or adjusted under 35 U.S.C. 154(b) by 1106 days.

(21) Appl. No.: 12/811,339

(22) PCT Filed: Jan. 22, 2009

(86) PCT No.: PCT/JP2009/050985

§ 371 (c)(1),
(2), (4) Date: Jun. 30, 2010

(87) PCT Pub. No.: WO2009/096314

PCT Pub. Date: Aug. 6, 2009

(65) Prior Publication Data

US 2010/0284851 A1 Nov. 11, 2010

(30) Foreign Application Priority Data

Jan. 31, 2008 (JP) ..... 2008-021355

(51) Int. Cl.

| | |
|---|---|
| ***C22C 9/02*** | (2006.01) |
| ***C22C 9/00*** | (2006.01) |
| ***C22C 9/06*** | (2006.01) |
| ***C22F 1/08*** | (2006.01) |
| ***H01R 13/03*** | (2006.01) |
| *H01R 13/11* | (2006.01) |

(52) U.S. Cl.

CPC ..... *C22C 9/02* (2013.01); *C22C 9/00* (2013.01); *C22C 9/06* (2013.01); *C22F 1/08* (2013.01); *H01R 13/03* (2013.01); *H01R 13/113* (2013.01)

(58) Field of Classification Search

CPC ..... C22C 9/00; C22C 9/02; C22C 9/06; C22F 1/08; H01R 13/03

USPC ..... 148/433; 420/473

See application file for complete search history.

(56) References Cited

U.S. PATENT DOCUMENTS

| | | | | |
|---|---|---|---|---|
| 2005/0092404 | A1 | 5/2005 | Aruga et al. | |
| 2005/0161126 | A1 | 7/2005 | Aruga et al. | |
| 2006/0137773 | A1 | 6/2006 | Aruga et al. | |
| 2007/0148032 | A1 | 6/2007 | Aruga et al. | |
| 2008/0025867 | A1 | 1/2008 | Aruga et al. | |
| 2009/0010797 | A1 | 1/2009 | Aruga et al. | |
| 2009/0084473 | A1 | 4/2009 | Aruga et al. | |
| 2009/0101243 | A1 | 4/2009 | Aruga et al. | |
| 2009/0101323 | A1 | 4/2009 | Takagi et al. | |
| 2009/0116996 | A1* | 5/2009 | Aruga et al. | 420/472 |
| 2009/0311128 | A1 | 12/2009 | Aruga et al. | |
| 2010/0072584 | A1 | 3/2010 | Aruga et al. | |

FOREIGN PATENT DOCUMENTS

| | | |
|---|---|---|
| JP | 3 6341 | 1/1991 |
| JP | 2 844120 | 1/1999 |
| JP | 11 293367 | 10/1999 |
| JP | 2001 262255 | 9/2001 |
| JP | 2002 294368 | 10/2002 |
| JP | 2007 107087 | 4/2007 |
| JP | 2007 169741 | 7/2007 |
| KR | 10-2008-0007403 | 1/2008 |
| WO | WO 2006/132317 A1 | 12/2006 |

OTHER PUBLICATIONS

U.S. Appl. No. 12/672,092, filed Feb. 4, 2010, Aruga, et al.

Supplementary European Search Report dated Aug. 26, 2011 in European Patent Application No. EP20090705472, filed Jan. 22, 2009.

Office Action dated Aug. 23, 2011, in Chinese Patent Application No. CN2009103207, filed Jan. 22, 2009 (with English-language Translation).

Office Action dated Jun. 13, 2012, in Korean Patent Application No. 10-2010-7017084 with English language translation.

* cited by examiner

*Primary Examiner* — Christopher Kessler

(74) *Attorney, Agent, or Firm* — Oblon, McClelland, Maier & Neustadt, L.L.P.

(57) ABSTRACT

The invention provides a Cu—Ni—Sn—P alloy sheet satisfying the resistance property of stress relaxation in the direction perpendicular to the rolling direction and excellent in the other necessary properties as terminals and connectors. The invention relates to a Cu—Ni—Sn—P alloy sheet having a specific composition, which is made to contain specific atomic clusters containing at least any of an Ni atom or a P atom, as detected with a three-dimensional atom probe field ion microscope, in a specific density, by increasing the reduction ratio in the final cold rolling and by intentionally shortening the time for the rolling and the time to be taken before the final annealing at low temperature, and of which the necessary properties as a terminal or connector 3 are improved in that the resistance property of stress relaxation thereof in the direction perpendicular to the rolling direction is enhanced and the difference (anisotropy) in the resistance property of stress relaxation thereof between the parallel direction and the perpendicular direction to the rolling direction is reduced.

14 Claims, 2 Drawing Sheets

COPPER ALLOY SHEET EXCELLENT IN RESISTANCE PROPERTY OF STRESS RELAXATION

TECHNICAL FIELD

The present invention relates to a copper alloy sheet excellent in resistance property of stress relaxation. Specifically, the invention relates to a copper alloy sheet excellent in resistance property of stress relaxation, which is suitable for connecting parts such as automotive terminals and connectors.

BACKGROUND ART

In recent years, connecting parts such as automotive terminals and connectors are required to have a capability of securing reliability under high-temperature environments like in engine rooms. For the reliability under high-temperature environments, one of the most important properties is maintenance properties of mating force at a contact point, so-called, resistance property of stress relaxation.

FIG. 2 shows a structure of a box connector (female terminal 3) that is typical as a connecting part of automotive terminals, connectors or the like. FIG. 2(*a*) shows a front view, and FIG. 2(*b*) shows a cross-sectional view. In FIG. 2, the female terminal 3 is so designed that the push part 5 is semi-supported by the upper holder section 4. When the male terminal (tab) 6 is inserted into the holder, then the push part 5 undergoes elastic deformation, and owing to the reaction force thereto, the male terminal (tab) 6 is thereby fixed. In FIG. 2, 7 is a wire connecting part, and 8 is a fixing segment.

As in FIG. 2, in a case where a steady-state displacement is given to the spring part made of a copper alloy sheet and the male terminal (tab) 6 is mated with the contact point having a spring shape (push part) 5, and when kept under a high-temperature environment like in an engine room, then it comes to lose its mating force at the contact point with the lapse of time. Accordingly, resistance property of stress relaxation means the property of resistance to high temperatures of those connecting parts of such that, even when kept under high-temperature environments, the mating force at the contact point of the spring part made of a copper alloy sheet is not greatly lowered.

FIGS. 1(*a*) and (*b*) show a test apparatus for resistance property of stress relaxation under this standard. Using the test apparatus, one end of a test piece 1 cut as a strip is fixed to a rigid test bench 2 and the other end is cantilevered and consequently bent (degree of bending: d), and after left as such at a given temperature for a given period of time, this is gradually unloaded at room temperature, and the degree of bending after unloading (permanent distortion) is calculated as δ. The stress relaxation ratio (RS) is expressed as $RS=(\delta/d)\times 100$.

As copper alloys excellent in resistance property of stress relaxation, heretofore Cu—Ni—Si alloys, Cu—Ti alloys, Cu—Be alloys or the like are widely known. However, recently, Cu—Ni—Sn—P alloys have become used in which the amount of the additive elements is relatively small. The Cu—Ni—Sn—P alloys may form ingots in a shaft furnace which is a large-scale melting furnace having a wide opening to air, and the high productivity thereof enables great cost reduction.

Various proposals for methods for enhancing the resistance property of stress relaxation of those Cu—Ni—Sn—P alloys themselves have heretofore been made. For example, Patent Documents 1 and 2 mentioned below disclose that an intermetallic compound containing Ni and P in a matrix of Cu—Ni—Sn—P alloy is finely dispersed to thereby increase the electric conductivity and simultaneously enhance the resistance property of stress relaxation.

Patent Documents 2 and 3 mentioned below disclose that P content of a Cu—Ni—Sn—P alloy is reduced to give a solute copper alloy where precipitation of the compound containing Ni and P is reduced. Further, Patent Document 4 mentioned below discloses that the substantial temperature and retention time in finish heat treatment or annealing in production of a Cu—Ni—Sn—P alloy sheet is defined to thereby increase the electric conductivity and simultaneously enhance the resistance property of stress relaxation.

Further, in Patent Document 5 mentioned below, a fine compound containing Ni and having a size of 0.1 μm or less, as measured in an extraction residue method with a filter having an opening size of 0.1 μm, is increased in a Cu—Ni—Sn—P alloy while a coarse compound containing Ni and having a large size of more than 0.1 μM is reduced therein to thereby enhance the resistance property of stress relaxation in the direction perpendicular to the rolling direction. More concretely, the proportion of the coarse compound containing Ni and having a large size of more than 0.1 to the Ni content in the copper alloy is made to be 40% or less and the fine compound containing Ni and having a size of 0.1 μm or less therein is thereby increased.

Patent Document 1: Japanese Patent No. 2844120
Patent Document 2: Japanese Patent No. 3871064
Patent Document 3: JP-A-11-293367
Patent Document 4: JP-A-2002-294368
Patent Document 5: JP-A-2007-107087

DISCLOSURE OF THE INVENTION

Problems that the Invention is to Solve

The stress relaxation ratio of a rolled copper alloy sheet (obtained by rolling) is anisotropic, and the female terminal 3 in FIG. 2 may have a different stress relaxation ratio depending on the machine direction thereof as to whether the direction is in what direction to the rolling direction of the copper alloy sheet material. The same shall apply to determination of the stress relaxation ratio, and the test piece may have a different stress relaxation ratio depending on the machine direction thereof as to whether the direction is in what direction to the rolling direction of the copper alloy sheet material for the terminal. In this point, the stress relaxation ratio in the direction perpendicular to the rolling direction of the copper alloy sheet tends to be lower than the stress relaxation ratio in the parallel direction thereof.

In this point, in FIG. 2, in producing the female terminal 3 by pressing a copper alloy sheet material, the sheet material may be so positioned that the machine direction of the female terminal 3 (the machine direction of the push part 5) could be in the direction perpendicular to the rolling direction. In general, the part is required to have high resistance property of stress relaxation to the bending force (elastic deformation) in the machine direction of the push part 5. Accordingly, in a case where the sheet material is so positioned that it could be in the direction perpendicular to the rolling direction thereof, the copper alloy sheet is required to have high resistance property of stress relaxation not in the parallel direction but in the perpendicular direction to the rolling direction of the copper alloy sheet.

Therefore, when one has a high stress relaxation ratio not only in the parallel direction to the rolling direction but also in the perpendicular direction to the rolling direction, then one may satisfy the resistance property of stress relaxation for terminals or connectors, irrespective of the positioning direction of the copper alloy sheet material and in any case where the alloy sheet material is positioned in any of the parallel direction or the perpendicular direction to the rolling direction. However, in the above-mentioned Patent Documents 1 to 5, the stress relaxation ratio in the perpendicular direction to the rolling direction could not be increased sufficiently as yet, and further improvements are desired.

In view of this point, the present invention is to provide, as terminals or connectors, a Cu—Ni—Sn—P alloy sheet having a high stress relaxation ratio not only in the parallel direction to the rolling direction but also in the perpendicular direction to the rolling direction and excellent in resistance property of stress relaxation.

Means for Solving the Problems

To attain an object, the subject matter of the copper alloy sheet excellent in resistance property of stress relaxation of the invention is as follows.

(1) A copper alloy sheet excellent in resistance property of stress relaxation, comprising Ni: 0.1 to 3.0 mass %, Sn: 0.01 to 3.0 mass %, P: 0.01 to 0.3 mass % and a remainder comprising a copper and an inevitable impurity, wherein an atomic cluster which is detected with a three-dimensional atom probe field ion microscope is contained in the copper alloy sheet, the atomic cluster comprises at least any of an Ni atom or a P atom, a distance between the Ni atom or P atom and an Ni atom or P atom adjacent to the Ni atom or P atom is 0.90 nm or less, a total number of a Cu atom, the Ni atom and the P atom contained in the atomic cluster is 15 or more and less than 100, and an average density of the atomic clusters is $5\times10^5/\mu m^3$ or more.

(2) The copper alloy sheet excellent in resistance property of stress relaxation according to (1), which further comprises at least one element selected from Fe: more than 0 and 0.5 mass % or less, Zn: more than 0 and 1 mass % or less, Mn: more than 0 and 0.1 mass % or less, Si: more than 0 and 0.1 mass % or less, and Mg: more than 0 and 0.3 mass % or less.

(3) The copper alloy sheet excellent in resistance property of stress relaxation according to (1) or (2), which further comprises Ca, Zr, Ag, Cr, Cd, Be, Ti, Co, Au and Pt in a total amount of 1.0 mass % or less.

(4) The copper alloy sheet excellent in resistance property of stress relaxation according to any one of (1) to (3), which further comprises Hf, Th, Li, Na, K, Sr, Pd, W, S, C, Nb, Al, V, Y, Mo, Pb, In, Ga, Ge, As, Sb, Bi, Te, B and Misch metal in a total amount of 0.1 mass % or less.

Advantageous Effects

In the invention, regarding the mechanism of enhancing resistance property of stress relaxation, it has been investigated a method of maximizing the pinning force (pinning effect) in dislocation movement at room temperature and under thermal activity, based on the dislocation theory. As a result, it has been reached an idea of using not micron-order, though fine, precipitates that have heretofore been noted in the above-mentioned Patent Documents but further finer atomic clusters at an atomic level that have heretofore not been noted at all. The atomic clusters may be referred to as ultra-fine precipitates, but as fine at an atomic level, they do not have a definite crystal structure like that of ordinary precipitates. Accordingly, in the invention, the matter is referred to as atomic clusters but not as ultra-fine precipitates.

With that, the inventors have dispersed atomic clusters corresponding to 10 atoms (a diameter of less than 5 nm) in a Cu—Ni—Sn—P alloy at a high density, and have theoretically introduced the fact that the pinning force in dislocation movement is maximized at room temperature and under thermal activity and the resistance property of stress relaxation is thereby enhanced.

To support the fact, the inventors have further tried analyzing the atomic cluster corresponding to about 10 atoms, using a three-dimensional atom probe field ion microscope to be mentioned below that makes it possible to analyze an atomic structure of less than 100 atoms. Specifically, it has been analyzed some Cu—Ni—Sn—P alloys differing from each other in the resistance property of stress relaxation in the perpendicular direction to the rolling direction thereof, and has been confirmed the difference in the existence morphology (existence state) of the atomic clusters from each other.

As a result, it has been found that Cu—Ni—Sn—P alloy sheet may significantly differ in the resistance property of stress relaxation, depending on the existence state of the atomic clusters specifically defined in the invention, though they do not differ in the other material conditions. Specifically, when the number of the clusters specifically defined in the invention is larger, then the resistance property of stress relaxation can be enhanced more in the direction perpendicular to the rolling direction and the anisotropy thereof in a specific direction, for example, in the parallel direction or the perpendicular direction to the rolling direction is reduced (the difference in the resistance property of stress relaxation between the parallel direction and the perpendicular direction to the rolling direction is reduced). "No difference in the other material conditions" as referred to herein means that the sheets differing from each other in a point of the level of the resistance property of stress relaxation have no other differences, needless-to-say, not only in the ingredient composition of the sheets but also in the structure observation of the sheets with ordinary TEM or SEM as well as in the extraction residue analysis or the X-ray diffraction analysis.

The atomic cluster, as specifically defined in the invention, has a size of about 50 Å (angstroms) or less even though it comprises 100 atoms. Accordingly, at present, even with a transmission electronic microscope (TEM) having a maximum magnification of 200,000, the cluster is barely detected (the level is detection limit) or the level is the detection limit or less. Most final products of copper alloy sheets are finally cold-rolled ones in order to have an increased strength, and in samples with many dislocations owing to cold rolling, dislocations could hardly be differentiated from precipitates. Accordingly, even with the TEM having such a maximum magnification, in practice, the atomic clusters specifically defined in the invention could not be observed (detected).

According to the extraction residue method with a filter having an opening size of 0.1 μm as in the Patent Document 5, it is possible to differentiate fine precipitates having a size of 0.1 μm or less and coarse precipitates having a size of more than 0.1 μm from each other. However, even though they are fine precipitates having a size of 0.1 μm or less, it is impossible to know them as to whether they are atomic clusters of 15 or more and less than 100 atoms as specifically defined in the invention, or any other larger precipitates than the atomic clusters, or any other solute elements.

Specifically, these facts mean that, even when sheets differing from each other in the degree of resistance property of stress relaxation are analyzed through structure observation with TEM or SEM or through extraction residue analysis or X-ray diffraction analysis, it is impossible by all means to detect the difference in the existence state of the atomic clusters specifically defined in the invention. Further, they mean that, even with the above-mentioned TEM having a maximum magnification or even according to the above-mentioned extraction residue method, it is still impossible to know the presence or absence of the atomic clusters specifically defined in the invention.

On the other hand, the analysis with a three-dimensional atom probe field ion microscope is generally applied to analysis of highly densified magnetic recording films, electronic devices or the like. In addition, it is used for structure analysis in the field of steels. For example, in JP-A-2006-29786, it is used for analysis of fine precipitates containing carbon in steels to determine the kind and the amount of the elements contained therein. In JP-A-2007-254766, it is used for analysis of the C amount and the N amount (atoms/$nm^2$) in the interface between the sulfide and Fe in steels.

However, in the field of copper alloys according to the invention, there is known almost no example of using the three-dimensional atom probe field ion microscope. This is because of the reason that, owing to the difference in the production conditions to be mentioned below, in the conventional Cu—Ni—Sn—P alloy sheets, naturally there exist few atomic clusters specifically defined in the invention. Accordingly, in prior arts, even when analyzing Cu—Ni—Sn—P alloy sheets with the three-dimensional atom probe field ion microscope is tried, the possibility itself of detecting the atomic clusters, of which the number is naturally small, is considerably low.

In the absence of a technical idea of discussing the mechanism of enhancing the resistance property of stress relaxation based on the above-mentioned dislocation theory, naturally no one should have any motivation to try analyzing the copper alloy sheets with a three-dimensional atom probe field ion microscope. The reason why no description is known in prior arts relating to examples of using a three-dimensional atom probe field ion microscope in the field of copper alloys or relating to the atomic clusters as specifically defined in the invention may be because of the circumstances as above.

DESCRIPTION OF REFERENCE NUMERALS

Figure 1:
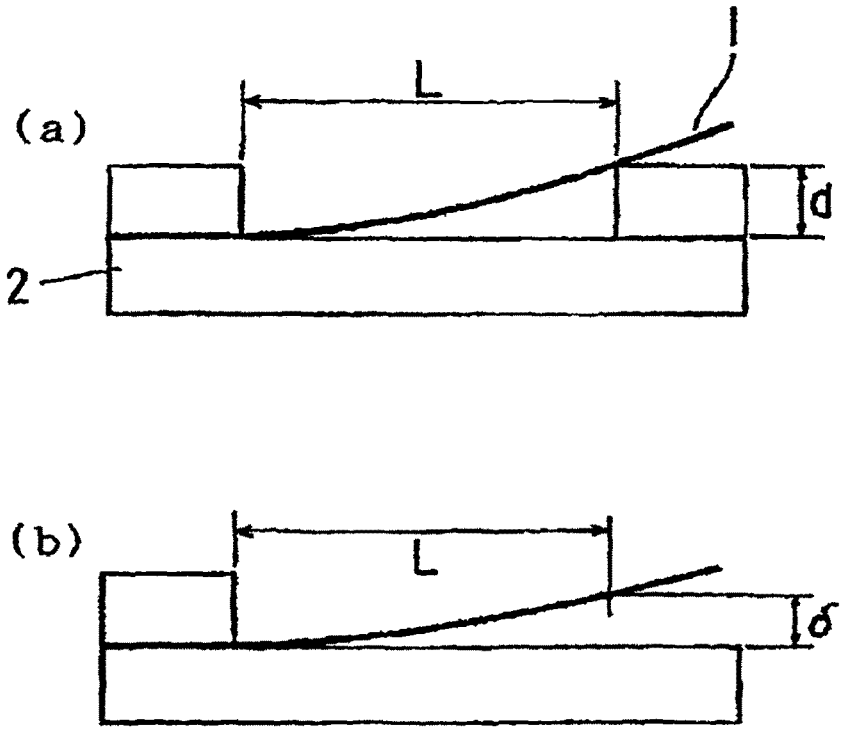
FIG. 1 This is a cross-sectional view for explaining a stress relaxation test for a copper alloy sheet.
Figure 2:
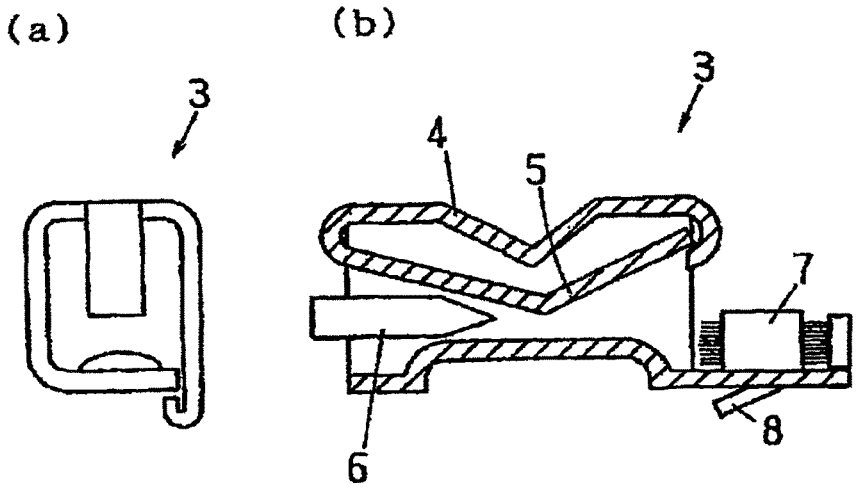
FIG. 2 This is a cross-sectional view showing a structure of a box connector.

1: Test Piece, 2: Test Bench, 3: Box Connector (female terminal), 4: Upper Holder Section, 5: Push Part, 6: Male Terminal, 7: Wire Connecting Part, 8: Fixing Segment

BEST MODE FOR CARRYING OUT THE INVENTION (Three-Dimensional Atom Probe Field Ion Microscope)

The atomic cluster comprising 15 or more and less than 100 atoms, as specifically defined in the invention, is, at present, detectable with only a known three-dimensional atom probe field ion microscope. The three-dimensional atom probe field ion microscope (3DAP: 3D Atom Probe Field Ion Microscope; hereinafter this may be abbreviated as 3DAP) comprises a time-of-flight mass spectrometer fitted to a field ion microscope (FIM). Having the constitution, this is a local analyzer capable of observing the individual atoms on a metal surface with the field ion microscope to identify the atoms through time-of-flight mass spectrometry. 3DAP can analyze both the kind and the position of the atoms released from a sample at the same time, and therefore it is an extremely effective device for structural analysis of atomic clusters. Accordingly, as so mentioned in the above, this is used for magnetic recording films and electronic devices and for structure analysis of steels.

In 3DAP, a high voltage is applied to the sample of which the tip is shaped like a needle to utilize the high electric field occurring at the tip, then the atomic structure of the tip of the sample is analyzed. In the field ion microscope (FIM), first the imaging gas introduced into the vacuum chamber is ionized at around the tip of the sample, and then this continuously ionizes the substance of the sample at the needle-like tip. As led by the electric field, the ionized atoms are moved in order toward the detector side such as the micro channel plate to be put to face the sample, and then form an image.

The detector is a position-sensitive detector and is so designed that it can attain mass spectrometry of individual ions (for identification of the element which is an atomic species) and can determine the time of flight of the individual atoms to the detector, thereby simultaneously capable of determining the detection position (atomic structure position). Accordingly. 3DAP can determine both the position and the atomic species of the atoms at the tip of the sample at the same time, and is therefore characterized in that it can three-dimensionally reconstruct and observe the atomic structure of the tip of the sample. In addition, since the field evaporation occurs in order from the tip surface of the sample, the depth direction distribution of the atoms from the tip of the sample can be analyzed through atomic-level resolution.

3DAP utilizes a high electric field, and the sample to be analyzed with it must have high electric conductivity of metal or the like, and in addition, regarding the shape thereof, the sample must have an ultra-thin needle-like tip having a tip diameter of about 100 nmϕ or less. Accordingly, a sample is taken out of a Cu—Ni—Sn—P alloy sheet at the center of the thickness thereof, and the sample is cut and electrolytically polished with a precision cutting device to give a sample for analysis having the above-mentioned ultra-thin needle-like tip part. The method of analysis is as follows: For example, using "LEAP 3000X" manufactured by Imago Scientific Instruments Corporation, a high-pulse voltage on a 10 kV order is imparted to the copper alloy sheet sample having a needle-like tip whereby millions of atoms are continuously ionized from the tip of the sample. The test region is within a range having a sample tip diameter of about 50 nmϕ, and the depth up to about 100 nm from the sample tip. The ions are detected with the position-sensitive detector; and based on the time of flight taken from the flight of the individual ions from the sample tip after impartation of the pulse voltage thereto, to the arrival to the detector, the ion mass spectrometry (identification of the element which is an atomic species) is attained.

Further, utilizing the property of the sample that its field evaporation occurs regularly in order from the tip surface of the sample, a coordinate of the depth direction is suitably given to the two-dimensional map indicating the arrival site of ions, then three-dimensional mapping (three-dimensional atom map construction) is attained using a software for analysis "IVAS". This gives a three-dimensional atom map of the sample tip.

The three-dimensional atom map is further analyzed through data envelopment analysis (DEA). Specifically, in the three-dimensional atom map, those where the distance between the adjacent Ni atoms and P atoms is 0.90 nm or less and where the total number of the Cu atoms, the Ni atoms and the P atoms is 15 or more and less than 100 are taken as the atomic clusters specifically defined in the invention; and the density by number is determined and evaluated. The cluster density determination is attained for three samples, and the data are averaged.

An outline of the above-mentioned data envelopment analysis (DEA) method is described in a report "ISDL Report No. 20020202002" by Masaya Watanabe, Tomoyuki Hiroyasu & Mitsunori Miki or the like. As described therein, the method is a known method (software). The data envelopment analysis method is for evaluating subjects from the viewpoint of efficiency in analysis of multi-purpose issues of multi-inputting and multi-outputting. Specifically, this is a method (software) for efficient analysis and identification for obtaining a larger quantity of outputted data from a smaller quantity of inputted data through efficiency evaluation (weighting) derived from (sum total of outputted data/sum total of inputted data). After proposed by Charnes et al. of the University of Texas in 1978, the method is utilized in various fields not only for metal analysis in the 3DAP but also for company, management, business diagnosis, social system analysis and the like.

(Atom Detection Efficiency in 3DAP)

However, at present, the atom detection efficiency in 3DAP is about 50% or less of all the ionized atoms, and the remaining atoms could not be detected. In case where the atom detection efficiency in 3DAP greatly changes, for example, it increases in future, then there may be a possibility that the determined data of the average density by number of the atomic clusters specifically defined in the invention (cluster/$\mu m^3$) in 3DAP may change in future. Accordingly, for securing the reproductivity of the determination of the average density by number of the atomic clusters, it is desirable that the atom detection efficiency in 3DAP is defined to be nearly constant, about 50%.

(Definition of Atomic Cluster)

In the invention, the atomic clusters, as specifically defined in the invention, are so defined that the cluster contains at least any of an Ni atom or a P atom, in which a distance between the Ni atoms and the P atoms adjacent to each other is 0.90 nm or less, and the total number of the Cu atoms, the Ni atoms and the P atoms is 15 or more and less than 100, and the average density by number (cluster/$\mu m^3$), and are determined for evaluation of the clusters. The atoms adjacent to each other as referred to herein mean not only an Ni atom and a P atom which are different from each other but also Ni atoms or P atoms which are same each other. In this point, for example, in case where either of Ni or P atom is not detected and the number of the atoms is 0, the atoms satisfy the atomic clusters as specifically defined in the invention so far as either of the Ni atoms or the P atoms satisfy the requirement of the adjacent distance (0.90 nm or less) and the number of the atoms (15 or more and less than 100), and they are counted for the average density by number of the atomic clusters specifically defined in the invention. With regard to an atom adjacent, for example, for an Ni atom, the atom adjacent to the Ni atom means an Ni atom or a P atom nearest to the Ni atom.

Accordingly, more concretely, the atomic cluster as specifically defined in the invention necessarily contains both Ni and P atoms or either of an Ni atom or a P atom. The atomic cluster is so designed that the distance between the Ni atom and P atom which are different from each other, or Ni atoms or P atoms which are same each other adjacent to each other is 0.90 nm or less, and the total number of the Cu atoms, the Ni atoms and the P atoms constituting it is 15 or more and less than 100. Accordingly, as a result of determination through the above 3DAP analysis, even though the number of the atoms falling within the above-defined adjacent distance range could satisfy the above-mentioned density by number, the atomic cluster could not be one specifically defined in the invention when it does not contain any of an Ni or P atom, and should not be counted for the atomic cluster according to the invention. Further, in case where the distance between the atoms adjacent to the Ni atom or the P atom from each other is too large (in case where the adjacent atoms do not exist in a site of 0.90 nm or less), the atomic clusters could not be the atomic clusters specifically defined in the invention.

Further, some copper alloy compositions naturally contain atoms such as Sn, Fe and the like (alloy elements or impurities-derived elements) other than the Cu atom, Ni atom and Patom in the atomic clusters therein, and such other atoms may be inevitably counted in 3DAP analysis. However, even when the other atoms such as Sn, Fe, Zn, Mn, Si and Mg (alloy elements or impurities-derived elements) are contained in the atomic clusters, the number thereof is smaller than the total number of Cu, Ni and P atoms, and may be on a level of a few atoms or less (less than 10 atoms in total). Accordingly, even when such the atomic clusters contain other atoms, they may function as the atomic clusters according to the invention so far as they satisfy the requirement of above-defined distance between the Ni and P atoms and the above-defined total number of the Cu, Ni and P atoms, similarly to the atomic clusters consisting only of Cu, Ni and P atoms. Accordingly, in case where the atomic clusters satisfying the above-defined density by number of the adjacent atoms that fall within the defined distance should be counted as the atomic clusters according to the invention even though they contain any other atoms therein. However, in case where the atomic clusters not satisfying the above-defined density by number of the adjacent atoms that fall within the defined distance should not be counted as the atomic clusters according to the invention.

The atomic clusters according to the invention include 6 kinds of combinations of Cu—Ni—P, Cu—Ni, Cu—P, Ni—P, Ni alone, and P alone. In fact, however, the atomic clusters to be counted through the 3DAP analysis of copper alloy sheets produced under suitable conditions to be mentioned below include mostly Cu—Ni—P but include a small amount of Cu—Ni, and the others are not almost observed (counted). The atomic clusters according to the invention are formed through diffusion and trapping, in final heat treatment or annealing at low temperature, of Cu, Ni and P atoms in the atomic voids to be the nuclei of the atomic clusters formed during cooling for heat treatment or annealing before final cold rolling and during final cold rolling, as so mentioned below.

(Meaning of Definition of Atomic Clusters)

In the invention, the Cu—Ni—Sn—P alloy sheet contains, in the sheet structure thereof, the atomic clusters as defined by the above-mentioned definition and detected in the 3DAP analysis, on a level of an average density of $5\times10^5$ clusters/$\mu m^3$ or more. Accordingly, the Cu—Ni—Sn—P alloy sheet may have enhanced resistance property of stress relaxation. Specifically, when the number of the atomic clusters specifically defined in the invention is larger, then the resistance property of stress relaxation can be enhanced more in the direction perpendicular to the rolling direction, and the anisotropy thereof in a specific direction, for example, in the parallel direction or the perpendicular direction to the rolling direction is reduced (the difference in the resistance property of stress relaxation between the parallel direction to the rolling direction and the perpendicular direction to the rolling direction is reduced).

As opposed to this, when the average density of the atomic clusters is less than $5\times10^5$ clusters/$\mu m^3$, then the number of the atomic clusters is too small and therefore the pinning force in dislocation movement at room temperature and under thermal activity could not be maximized. As a result, the resistance property of stress relaxation of the Cu—Ni—Sn—P alloy sheet could not be enhanced.

The total number of the Cu atoms, the Ni atoms and the P atoms in the atomic cluster according to the invention is defined to be 15 or more and less than 100. This is because, when the total number thereof is less than 15, then the size thereof is less than 10 A and is too small, and the pinning force in dislocation movement at room temperature and under thermal activity may be small. On the other hand, when the total number of the Cu atoms, the Ni atoms and the P atoms constituting the atomic cluster is 100 or more, then the atomic cluster may be too rough, and would be therefore ineffective for maximizing the pinning force in dislocation movement at room temperature and under thermal activity necessary for enhancement of the resistance property of stress relaxation.

(Ingredient Composition of Copper Alloy)

Next, the ingredient composition of the copper alloy of the invention is described below. As the premise of the ingredient composition thereof, the copper alloy of the invention is a Cu—Ni—Sn—P alloy capable of forming ingots in a shaft furnace and enabling great cost reduction owing to the high productivity thereof, as so mentioned in the above.

In order that the copper alloy is applicable to the pressing process for producing connecting parts such as high-efficiency and high-speed automotive terminals and connectors and that it may satisfy the requirements for those connecting parts such as automotive terminals and connectors, the copper alloy is specifically so designed from the side of the ingredient composition thereof that it can be excellent in the strength, the resistance property of stress relaxation and the electric conductivity. For this, the ingredient composition of the Cu—Ni—Sn—P alloy comprises Ni: 0.1 to 3.0%, Sn: 0.01 to 3.0%, P: 0.01 to 0.3%, and a remainder comprising a copper and inevitable impurity. All the expression of percent for the content of each element means mass percent. The alloy elements of the copper alloy are described below in point of the reason for their addition and the reason for their inhibition.

(Ni)

Ni is an important element for forming, along with P, an atomic cluster specifically defined in the invention comprising 15 or more and less than 100 atoms, thereby to enhance the strength and the resistance property of stress relaxation. In addition, it is an element necessary for enhancing the strength and the resistance property of stress relaxation by forming a solute thereof in the copper alloy matrix or forming therein a fine precipitate or a compound along with any other alloy elements such as P in an ordinary manner.

When the Ni content is less than 0.1%, then the density of the atomic clusters comprising less than 100 atoms, as specifically defined in the invention, may be insufficient and the resistance property of stress relaxation may lower, even though produced according to the most suitable production method according to the invention. In addition, the absolute amount of the compound containing Ni larger than this and that of the amount of the solute Ni may also be insufficient, therefore also resulting in the reduction in the strength and the resistance property of stress relaxation. Accordingly, the Ni content must be 0.1% or more, more preferably 0.3% or more.

However, when the content of Ni is more than 3.0%, and more severely more than 2.0%, then compounds such as oxides containing Ni, crystallized products containing Ni and precipitated products containing Ni may be coarse, or coarse compounds containing Ni may increase, while, on the other hand, the amount of fine Ni compounds containing Ni and the amount of solute Ni may decrease. The coarse compound containing Ni may be a start point for breakage. As a result, the resistance property of stress relaxation may rather reduce and the strength and the bendability may also reduce. Accordingly, the Ni content is within a range of 0.1 to 3.0%, preferably 0.3 to 2.0%.

(Sn)

Sn is solidified in the copper alloy matrix to enhance the strength of the alloy. Further, the solute Sn inhibits softening and stress relaxation to be caused by recrystallization during heat treatment or annealing. When the Sn content is less than 0.01%, then the amount of Sn is too small and the stress relaxation could not be inhibited. On the other hand, when the Sn content is more than 3.0%, the electric conductivity greatly lowers, and could not be 30% IACS or more, and in addition, the solute Sn may segregate in the grain boundary to lower the strength and the bendability. Accordingly, the Sn content is within a range of 0.01 to 3.0%, preferably 0.1 to 2.0%.

(P)

P is an important element that forms, along with Ni, the atomic cluster comprising 15 or more and less than 100 atoms as specifically defined in the invention, thereby enhancing the strength and the resistance property of stress relaxation. In addition, it is an element necessary for enhancing the strength and the resistance property of stress relaxation by forming a fine precipitate along with any other elements such as Ni in an ordinary manner. P acts also as a deoxidation agent. When the P content is less than 0.01%, then the density of the atomic clusters comprising less than 100 atoms, as specifically defined in the invention, may be insufficient and the resistance property of stress relaxation may lower, even when produced according to the most suitable production method according to the invention. In addition, precipitate particles containing P larger than this may also be insufficient, and the resistance property of stress relaxation therefore lowers. Accordingly, the P content must be 0.01% or more. However, when the P content is too large, over 0.3%, then the compound containing P may be coarse and the resistance property of stress relaxation may be thereby rather lowered, and the strength and the hot workability may also be lowered. Accordingly, the P content is within a range of 0.01 to 0.3%, preferably 0.02 to 0.2%.

(Fe, Zn, Mn, Si and Mg)

Fe, Zn, Mn, S and Mg are impurities that may be easily contained therein from melting materials such as scraps. These elements have their own effects, but generally they lower the electric conductivity. When their content is large, the alloy could hardly form ingots in a shaft furnace.

Accordingly, in order to obtain high electric conductivity, each element is controlled to Fe: more than 0 and 0.5% or less, Zn: more than 0 and 1% or less, Mn: more than and 0.1% or less, Si: more than 0 and 0.1% or less, and Mg: more than 0 and 0.3% or less. On the other hand, Fe, Zn, Mn, Si and Mg have additional effects as mentioned below, and reducing these Fe, Zn, Mn, Si and Mg results in the increase in the melting cost. Accordingly, in the invention, these Fe, Zn, Mn, Si, Mg are accepted so far as their content is more than 0, preferably 0.005% or more, but is the above-mentioned upper limit or less.

Like Sn, Fe increases the recrystallization temperature of the copper alloy. However, when the content is more than 0.5%, then the electric conductivity may lower. Preferably, the content is preferably 0.3% or less. Zn prevents peeling of tin plating. However, when its amount is more than 1%, then the electric conductivity may lower and it could not have a high electric conductivity. In case where the alloy forms ingots in a shaft furnace, the content is preferably 0.05% or less. Within a temperature range (about 150 to 180° C.) used as automotive terminals, the content of 0.05% or less may be effective for preventing peeling of tin plating. Mn and Si are effective as an antioxidation agent. However, when their content is more than 0.1%, then the electric conductivity may lower and it could not have a high electric conductivity. In case where the alloy forms ingots in a shaft furnace, the content is preferably controlled to Mn: 0.001% or less, and Si: 0.002% or less. Mg is effective for enhancing the resistance property of stress relaxation. However, when its amount is more than 0.3%, then the electric conductivity may lower and it could not have a high electric conductivity. In case where the alloy forms ingots in a shaft furnace, the content is preferably 0.001% or less.

(Ca, Zr, Ag, Cr, Cd, Be, Ti, Co, Au, Pt)

The copper alloy of the invention may further contain, as impurities, Ca, Zr, Ag, Cr, Cd, Be, Ti, Co, Au and Pt, in a total amount thereof of 1.0% or less, preferably 0.5% or less, more preferably 0.1% or less, and even more preferably the detection limit thereof or less. These elements are effective for inhibiting the grain size, however, when the total amount of those elements is more than 1.0, then the electric conductivity may lower and it could not have a high electric conductivity. In addition, the alloy could hardly form ingots in a shaft furnace.

Other than the above, Hf, Th, Li, Na, K, Sr, Pd, W, S, C, Nb, Al, V, Y, Mo, Pb, In, Ga, Ge, As, Sb, Bi, Te, B and Misch metal are also impurities, and may be preferably in a total amount of the elements of 0.1% or less, preferably 0.05% or less, more preferably 0.01% or less, and even more preferably the detection limit thereof or less.

(Method for Producing Copper Alloy Sheet)

Next, a method for producing the copper alloy sheet of the invention is desirable. The method itself for producing the copper alloy sheet of the invention may be the same as an ordinary method except for the condition in the finish heat treatment or annealing step thereof. Specifically, a final (product) sheet is obtained through forging of a molten metal of a copper alloy having a conditioned ingredient composition, facing the casting body, soaking and hot rolling, and repeated cold rolling and heat treatment or annealing. However, in order that the copper alloy sheet of the invention can have the necessary properties such as the strength and the resistance property of stress relaxation, the alloy sheet may be produced under preferred production conditions, which are described below.

The atomic cluster comprising 15 or more and less than 100 atoms, as specifically defined in the invention, is formed through final heat treatment or annealing at low temperature in the process of producing the copper alloy sheet. Accordingly, in order that the copper alloy sheet can have a stricture capable of satisfying the density of the atomic clusters, as specifically defined in the invention, in the final heat treatment or annealing at low temperature, it is necessary to control the condition of heat treatment or annealing in the previous step of final heat treatment or annealing before final cold rolling, the condition in the final cold rolling and further the time to be taken from the finish heat treatment or annealing to the final heat treatment or annealing at low temperature, as will be described hereinunder.

Specifically as described below, it is necessary that the average cooling rate to room temperature in the finish heat treatment or annealing is kept large (rapid) and that the time to be taken from the end of the finish heat treatment or annealing to the start of the final cold rolling (for which the sheet is kept at room temperature) is kept short. In addition, the reduction ratio in the final cold rolling must be kept large, and regarding the time from the end of the finish of the final cold rolling to the start of the final heat treatment or annealing at low temperature, the time for which the alloy sheet is kept at room temperature must be shortened.

First, in forging the copper alloy having composition of the invention, ingot formation at high productivity is possible in a shaft furnace, which is a large-scale melting furnace. However, it is desirable that the time to be taken from the finish of the addition of the alloy elements in the copper alloy melting furnace to the start of forging is within 1200 seconds, and that the time to be taken from taking out the ingots from the heating furnace to the end of the hot rolling thereof is within 1200 seconds, that is, the time is preferably shorter.

Shortening the time from the finish of the addition of the alloy elements in the copper alloy melting furnace to the start of forging, and shortening the time from taking out the ingots from the heating furnace to the end of the hot rolling thereof as above brings about inhibition of coarse compounds containing Ni and secures the amount of fine compounds containing Ni and the amount of solute Ni. As a result, the copper alloy sheet may have good electric conductivity, resistance property of stress relaxation and strength.

In this connection, even though the density of the atomic clusters comprising 15 or more and less than 100 atoms, as specifically defined in the invention, and the amount of fine compounds containing Ni and the amount of solute Ni are controlled by controlling mainly the cold-rolling condition and the heat treatment or annealing condition in the latter stage, the absolute amount of the fine compounds containing Ni and the solute Ni is reduced in the former stage process before the end of hot rolling. Further, in case where the amount of the coarse compounds containing Ni formed in the former stage step is large, then the fine products precipitated in the cold-rolling and heat treatment or annealing step may be trapped by the coarse products, and therefore the amount of the fine products independently existing in the matrix may be further smaller. Accordingly, even though the amount of Ni added is relatively large, there may be a possibility that one could not have sufficient strength and excellent resistance property of stress relaxation.

The hot rolling may be attained in an ordinary manner. The inlet temperature in hot rolling may be about 600 to 1000° C., and the finish temperature may be about 600 to 850° C. After the hot rolling, it may be cooled with water or may be cooled in air.

Next, the hot-rolled sheet is further subjected to, in order, primary cold rolling (rough cold rolling, intermediate cold rolling)→finish heat treatment or annealing (heat treatment or annealing before final cold rolling)→final cold rolling→final heat treatment or annealing at low temperature, thereby giving a thin copper alloy sheet. In the primary cold rolling (rough cold rolling, intermediate cold rolling), cold rolling and heat treatment or annealing may be repeated suitably depending on the thickness.

(Finish Heat Treatment or Annealing=Heat Treatment or Annealing Before Final Cold Rolling)

The finish heat treatment or annealing is conducted at a maximum achieving temperature falling within a range of 500 to 800° C. as the substantial temperature of the sheet, and the average cooling rate from that temperature to room temperature is 100° C./sec or more, preferably 150° C./sec or more, and more preferably 200° C./sec or more. When the average cooling rate is 100° C./sec or more, preferably 150° C./sec or more, and more preferably 200° C./sec or more, as combined with the reduction ratio in the subsequent final cold rolling of 60% or more, preferably 65% or more, and more preferably 70% or more, the number of atomic voids to be the nuclei of the atomic clusters to be formed in the final heat treatment or annealing at low temperature increases. On the contrary, when the average cooling rate is small (low), the number of the atomic voids to be the nuclei of the atomic clusters as specifically defined in the invention may decrease and may be insufficient, even though the reduction ratio in the subsequent final cold rolling is 60% or more. As a result, the number of the atomic clusters to be formed in the final heat treatment or annealing at low temperature may decrease, and there may be a possibility that the copper alloy sheet could not have the structure capable of satisfying the density of the atomic clusters as specifically defined in the invention.

(Final Cold Rolling)

The final cold rolling is conducted generally in 3 or 4 passes. However, in order that the structure of the copper alloy sheet produced can satisfy the density of the atomic clusters comprising 15 or more and less than 100 atoms as specifically indicated in the invention, first, the reduction ratio in the final cold rolling is controlled to be 60% or more, preferably 65% or more, and more preferably 70% or more. Accordingly, the number of the atomic voids to be the nuclei of the atomic clusters as specifically defined in the invention can increase and the atomic clusters can be formed in the subsequent final heat treatment or annealing at low temperature, therefore forming the structure of the copper alloy sheet that satisfies the density of the atomic clusters as specifically defined in the invention. On the other hand, when the reduction ratio in the final cold rolling is less than 60%, the number of the atomic voids to be the nuclei of the atomic clusters as specifically defined in the invention may decrease and may be insufficient, even though the reduction ratio in the primary cold rolling is 60% or more, and therefore the number of the atomic clusters to be formed in the final heat treatment or annealing at low temperature may decrease and the copper alloy sheet produced could not have the structure satisfying the density of the atomic clusters as specifically defined in the invention.

(Time to be Taken Before the Final Heat Treatment or Annealing at Low Temperature)

In order that the structure of the copper alloy sheet can satisfy the density of the atomic clusters, as specifically defined in the invention, in the final heat treatment or annealing at low temperature, the time for which the sheet is kept at room temperature between each step must be short, specifically 60 minutes or less, preferably 50 minutes or less, and more preferably 40 minutes or less, that is, the time before the final heat treatment or annealing at low temperature must be as short as possible, in addition to the above-mentioned requirements for each step.

Specifically, first, the time to be taken from the end of the finish heat treatment or annealing up to the final cold rolling, that is, the time to be taken from the arrival at room temperature of the sheet by cooling after the finish heat treatment or annealing to the start of the first pass of the final cold rolling must be as short as within 60 minutes. In addition, the time to be taken from the finish of the final cold rolling (after the finish of the final rolling pass) to the start of the final heat treatment or annealing at low temperature (heating of the sheet) must also be as short as within 60 minutes.

In case where the interval between each step for which the sheet is kept at room temperature is longer than 60 minutes, then the time before the final heat treatment or annealing at low temperature, that is, the time for which the sheet is kept at room temperature shall be long. Accordingly, the atomic voids to be the nuclei of the atomic clusters may be greatly trapped by rapidly diffusing H atoms, C atoms, O atoms or the like but not by the intended Cu atoms, Ni atoms or P atoms. Specifically, the trapping with these H atoms, C atoms, O atoms or the like may go on further in proportion to the time for which the sheet is kept at room temperature; and therefore, when the time to be taken at room temperature in each step is longer, then the number of the atomic voids to be the nuclei of the atomic clusters, which are trapped by the intended Cu atoms, Ni atoms or P atoms, decrease.

Accordingly, when the time to be taken in each step (the time for which the sheet is kept at room temperature) is longer than 60 minutes, the number or the atomic voids to be the nuclei of the atomic clusters as specifically defined in the invention decreases and becomes insufficient, even though the average cooling rate to room temperature in the heat treatment or annealing before the final rolling at low temperature is 100° C./sec or more and the reduction ratio in the final cold rolling is 60% or more. As a result, the number of the atomic clusters to be formed in the final heat treatment or annealing at low temperature decreases, and the copper alloy sheet could not have the structure satisfying the density of the atomic clusters as specifically defined in the invention. In the final cold rolling, the rolling for the above-mentioned number of passes could finish within a short period of time (for a few minutes) by reverse rolling or the like, and in addition, since the sheet is rolled under pressure, the atomic voids to be the nuclei of the atomic clusters are no more trapped further, and therefore, the time may be disregarded as the time for which the sheet is kept at room temperature.

In case where the holding time for which the sheet is kept at room temperature as the interval between the steps is not predominantly and intentionally shortened, it shall be inevitably longer, as correlated with many other predominant parameters and with any other lots and steps. Accordingly, in ordinary or conventional production methods, the holding time for which the sheet is kept at room temperature as the interval between the steps is not predominantly shortened, as correlated with many other predominant parameters and with any other lots or steps. Therefore, the time shall be inevitably longer in an order of a few hours. Accordingly, in ordinary or conventional production methods, the time for which the sheet is kept at room temperature as the interval between the steps may be almost inevitably longer than 60 minutes. As a result, the number of the atomic clusters to be formed in the final heat treatment or annealing at low temperature necessarily decreases, and the copper alloy sheet could not have the structure satisfying the density of the atomic clusters as specifically defined in the invention.

For preventing the H atoms, the C atoms, the O atoms or the like from diffusing in the atomic voids to trap them, the copper alloy sheet may be cooled with liquid nitrogen so as to be kept at an extremely low temperature but not at room temperature. However, at present, cooling to such an extremely temperature is not practicable for production of copper alloy sheets. Accordingly, in an ordinary sheet production process, the time to be taken from the end of the finish heat treatment or annealing to the final cold rolling, for which the sheet is kept at room temperature, and the time to be taken from the end of the final cold rolling to the start of the final heat treatment or annealing at low temperature may be as short as within 60 minutes each.

(Final Heat Treatment or Annealing at Low Temperature)

In the final heat treatment or annealing at low temperature, the atomic clusters comprising 15 or more and less than 100 atoms, as specifically defined in the invention, are formed. In the final heat treatment or annealing at low temperature, the atomic voids to be the nuclei of the atomic clusters are trapped through diffusion of each of Cu, Ni and P atoms therein, to thereby form the atomic clusters, and the copper alloy sheet thus produced can have the structure satisfying the density of the atomic clusters as specifically defined in the invention. The final heat treatment or annealing at low temperature may be conducted in any of a continuous annealing furnace (at a substantial temperature of 200 to 500° C. for about 10 to 60 seconds), or a batch annealing furnace (at a substantial temperature of 100 to 400° C. for about 1 to 20 hours).

EXAMPLES

Examples of the invention are described below. Thin sheets of the copper alloy having a different density of the atomic clusters comprising 15 or more and less than 100 atoms, as specifically defined in the invention, were produced under the above-mentioned preferable production conditions. Then, they were analyzed to determine their physical properties such as electric conductivity, tensile strength, 0.2% yield strength and resistance property of stress relaxation.

Concretely, copper alloys each having a chemical ingredient composition shown in Table 1 (in which the reminder except the elements shown therein is Cu) were melted in a coreless furnace, and then forged according to a semi-continuous forging method (cooling and solidifying rate in forging: 2° C./sec) to give an ingot having a thickness 70 mm×width 200 mm×length 500 mm. Each ingot was rolled under the condition mentioned below, common to all ingots, to give a thin sheet of the copper alloy. Namely, each ingot was faced on its surface, then heated, and further heated in a heating furnace at 960° C., and immediately subjected to hot rolling at a hot-rolling end temperature of 750° C. to give a plate having a thickness of 10 to 20 mm, which was then rapidly cooled in water from a temperature of 650° C. or more.

In this step, the time taken from the finish of the addition of the alloy element to the melting furnace to the start of forging was 1200 seconds or less, common to all samples; and the time taken from taking out from the heating furnace to the end of hot rolling was 1200 seconds or less, common to all samples.

After removing oxide scale therefrom, the hot-rolled plate was processed for primary cold rolling→finish heat treatment or annealing→final cold rolling→final heat treatment or annealing at low temperature to give a thin sheet of the copper alloy. Briefly, the hot-rolled plate was conducted for primary cold rolling (rough cold rolling, intermediate cold rolling), the plate was faced and then further processed for finish heat treatment or annealing in an annealing furnace in which the substantial temperature of the sheet was the maximum achieving temperature of 600° C., and the sheet was cooled from this temperature to room temperature at an average cooling rate varying as in Table 2. The time to be taken from the arrival at the room temperature of the sheet by cooling after the finish heat treatment or annealing to the start of the first pass of the final cold rolling was varied as in Table 2.

After this, the sheet was processed for final cold rolling with varying the reduction ratio as in Table 2. In the final cold rolling, the thickness of the final sheet was 0.25 mm, common to all samples. Specifically, the reduction ratio by the final cold rolling shown in Table 2 was varied by controlling the thickness of the sheet after the hot rolling and the thickness thereof after the primary cold rolling, and by varying the thickness of the sheet to be processed for final cold rolling (the sheet before processed for final cold rolling) in every Example.

In addition, the time to be taken just after the final pass of the final cold rolling to the start of the final heat treatment or annealing at low temperature (to the start of heating the sheet) was also varied as in Table 2. In the final heat treatment or annealing at low temperature, the temperature of heat treatment or annealing (substantial temperature: maximum achieving temperature of the sheet) alone was varied differently as in Table 2, and the sheet was kept at the temperature for 30 seconds. As a result of the final heat treatment or annealing at low temperature, a thin sheet product of the copper alloy (having a thickness of 0.25 mm, common to all samples) was produced.

In every copper alloy in Table 1, the remainder composition except the elements shown therein is Cu, and as other impurity elements, the content of the Group A elements, that is, Ca, Zr, Ag, Cr, Cd, Be, Ti, Co, Au and Pt, was 1.0 mass % or less as a total of these elements, common to all samples except those of Example 9 in Table 1 (Example 15 in Tables 2 and 3). The content of the Group B elements, that is, Hf, Th, Li, Na, K, Sr, Pd, W, S, Si, C, Nb, Al, V, Y, Mo, Pb, In, Ga, Ge, As, Sb, Bi, Te, B and Misch metal, was 0.1 mass % or less as a total of these elements, common to all samples except those of Example 10 in Table 1 (Example 16 in Tables 2 and 3).

Samples were cut out of the thus-produced copper alloy sheets in Examples, and analyzed for the properties such as the structure, the electric conductivity, the tensile strength, the 0.2% yield strength and resistance property of stress relaxation. The results are shown in Table 3.

(Determination of Structure)

Three samples collected from the thus-produced copper alloy sheets randomly at the center of each sheet were analyzed using the three-dimensional atom probe field ion microscope and software for analysis. Concretely, according to the test method under the condition mentioned in the above, the samples were analyzed for the average density ($\times 10^5/\mu m^3$) of the atomic clusters containing at least any of an Ni atom or a P atom, in which the distance between the Ni atom or P atom and an atom adjacent to the Ni atom or P atom is 0.90 nm or less and in which the total number of the Cu atoms, the Ni atoms and the P atoms constituting the cluster is 15 or more and less than 100. Common to all samples, some detected atomic clusters contained some other atoms than Cu, Ni and P atoms, that is, Sn, Fe, Zn, Mn, Si and Mg on a level of a few atoms (one or two atoms). However, the atomic clusters satisfying the defined distance between the Ni and P atoms and satisfying the requirement for the condition of the defined total number of Cu, Ni and P atoms were counted as the atomic clusters according to the invention.

(Determination of Average Grain Size)

According to a method of crystallographic orientation analysis with FESEM/EBSP, the average grain size of the copper ally plate sample was determined. As a result, common to all samples of Examples and Comparative Examples, the average grain size was 5.0 μm or less and they were fine. Common to all samples, the sites of the test piece to be analyzed were three sites randomly selected at the center of the sheet, and the data of the average grain size determined at these three sites were averaged to give the average grain size.

(Tensile Test)

A test piece is collected from the thin sheet of the copper alloy, and a tensile test piece in accordance with JIS No. 5 was prepared by machining in such a manner that the machine direction of the test piece could be perpendicular to the rolling direction. Using a universal tester 5882 Model manufactured by Instron Corporation, the test piece was analyzed for the mechanical properties including the elongation at room temperature and at a test speed of 10.0 mm/min under GL=50 mm. The yield strength is a tensile strength corresponding to a permanent elongation of 0.2%.

(Determination of Electric Conductivity)

A sample was collected from the thin sheet of the copper alloy, and analyzed for the electric conductivity. The electric conductivity of the copper alloy sheet sample was determined as follows: The sheet was worked by milling into a strip test piece having a width of 10 mm and a length of 300 mm. According to the method of JIS-H0505 for determination of the electric conductivity of non-iron metal material, the electric resistance of the test piece was measured with a double-bridge resistance tester, and the electric conductivity thereof was computed according to an average cross section method.

(Resistance Property of Stress Relaxation)

The stress relaxation ratio of the thin sheet of the copper alloy was determined in the direction parallel to the rolling direction and in the direction perpendicular thereto in which the ratio is severer than that in the parallel direction, and the sample was evaluated in point of the resistance property of stress relaxation in these directions. In the test of determining the stress relaxation ratio mentioned below, the samples of which the stress relaxation ratio in the direction parallel to the rolling direction and perpendicular to the rolling direction are less than 10% and of which the difference in the stress relaxation ratio between the parallel direction and the perpendicular direction is 3% or less are good in point of the resistance property of stress relaxation.

Concretely, sample pieces were collected from the thin sheet of the copper alloy and the stress relaxation ratio is determined according to a semi-supporting method shown in FIG. 1. A strip test piece 1 having a width of 10 mm (the long direction is perpendicular to the rolling direction of the sheet) is cut out, its one end is fitted to a rigid test bench 2, and a deflection on a level of d (=10 mm) is given to the part of the spun length L of the test piece 1. In this stage, L is so designed that a surface stress corresponding to 80% of the yield strength of the material can be given to the material. This is kept in an oven at 120° C. for 3000 hours, then taken out, and the permanent distortion δ thereof is measured after removal of the deflection d, and the stress relaxation ratio (RS: %) is computed as $RS=(\delta/d)\times 100$.

As is obvious from Tables 1 and 2, the copper alloys in Examples (Alloy Nos. 1 to 10) falling within the scope of the composition of the invention in Table 1, in particular, the heat treatment or annealing before the final rolling at low temperature was conducted within a range of 500 to 800° C. and the average cooling rate from that temperature to room temperature was 100° C./sec or more. In addition, the alloys were produced as follows. The reduction ratio in the final cold rolling was 60% or more, and regarding the time taken from the end of the finish heat treatment or annealing to the start of the final cold rolling and the time to be taken from the end of the final cold rolling to the final heat treatment or annealing at low temperature, the time for which they were kept at room temperature was 60 minutes or less. Further, they satisfy the other preferred production conditions mentioned in the above.

Accordingly, as is obvious from Table 3, in Examples, ones contain the atomic clusters according to the invention in an average density of $5\times 10^5/\mu m^3$ or more, as determined with a three-dimensional atom probe field ion microscope.

In addition, in Examples, ones have a composition falling within a suitable range and were produced under the above-mentioned preferred conditions, in which, therefore, it may be considered that the formation of coarse compounds containing Ni such as oxides containing Ni, crystallized products containing Ni and precipitated products containing Ni could be inhibited and the amount of relatively large but fine compounds containing Ni or the like and the amount of solute Ni except the above-mentioned atomic clusters could be secured.

As a result, in Examples, ones have properties of terminals and connectors in that their electric conductivity is 30% IACS or more, and the severer stress relaxation ratio in the direction perpendicular to the rolling direction thereof is less than 10%. In addition, the difference between the stress relaxation ratio in the perpendicular direction to the rolling direction and that in the parallel direction thereto is as small as about 2 to 3%. Furthermore, the mechanical property is that the 0.2% yield strength is 500 MPa or more. Namely, in Examples the copper alloy sheets have high electric conductivity and high strength and are especially excellent in resistance property of stress relaxation, thus satisfying all these properties.

However, in Tables 2 and 3, in Examples 15 and 16 (Alloy Nos. 9, 10) in which the amount of the other elements is more than the above-mentioned preferred upper limit, ones have a relatively lower electric conductivity than in the other Examples. In Example 15, the total of the elements of the Group A elements is over the above-mentioned preferred upper limit, that is 1.0 mass %, and is high as in Alloy No. 9 in Table 1. In Example 16, the total of the elements of the Group B elements is over the above-mentioned preferred upper limit, that is 0.1 mass %, and is high as in Alloy No. 10 in Table 1.

In Example 9 (Alloy No. 3 in Table 1) in Tables 2 and 3, the Ni content is 0.1% which is the lower limit. In Example 10 (Alloy No. 4 in Table 1), the Ni content is 3.0% which is the upper limit. In Example 11 (Alloy No. 5 in Table 1), the Sn content is 0.01% which is the lower limit. In Example 12 (Alloy No. 6 in Table 1), the Sn content is 3.0% which is the upper limit. In Example 13 (Alloy No. 7 in Table 1), the P content is 0.01% which is the lower limit. In Example 14 (Alloy No. 8 in Table 1), the P content is 0.3% which is the upper limit.

In Examples 2 to 4, and 6 to 8 in Table 2, the cooling rate after the finish heat treatment or annealing is 100° C./sec or more but is relatively low, or the reduction ratio in the final cold rolling is 60% or more but is relatively low, or the time taken in each step before the final heat treatment or annealing at low temperature is within 60 minutes but is relatively long. Accordingly, in these Examples, the average density of the atomic clusters according to the invention is relatively small, as compared with that in Examples 1 and 5 in Table 2 in which the other conditions are the same but the reduction ratio in the final cold rolling is relatively high and the time taken in each step before the final heat treatment or annealing at low temperature is relatively short, as in Table 3. As a result, in these Examples, the resistance property of stress relaxation and the strength of the samples are relatively low, as compared with those in Examples 1 and 5.

As opposed to this, in Comparative Examples 17 to 22 in Tables 2 and 3, the samples were produced under preferred conditions. However, in these Comparative Examples, the compositions of the copper alloys, that is Alloy Nos. 11 to 16 in Table 1, are outside the scope of the invention, and therefore, the structure of the alloys such as the average density of the atomic clusters according to the invention is outside the scope of the invention, and even if the structure thereof falls within the scope of the invention, any of the electric conductivity, the strength and the resistance property of stress relaxation are extremely inferior to those in Examples.

In Comparative Example 17, the Ni content is lower than the lower limit (Alloy No. 11 in Table 1). Accordingly, the strength and the resistance property of stress relaxation are low. In Comparative Example 18, the Ni content is higher than the upper limit (Alloy No. 12 in Table 1). Accordingly, the balance between the strength and the electric conductivity is poor.

In Comparative Example 19, the Sn content is lower than the lowermost limit (Alloy No. 13 in Table 1). Accordingly, the strength and the resistance property of stress relaxation are too low. In Comparative Example 20, the Sn content is higher than the upper limit (Alloy No. 14 in Table 1). Accordingly, the electric conductivity is low.

In Comparative Example 21, the P content is lower than the lower limit (Alloy No. 15 in Table 1). Accordingly, the strength and the resistance property of stress relaxation are low. In Comparative Example 22, the P content is higher than the upper limit (Alloy No. 16 in Table 1). Accordingly, cracking occurred during hot rolling, and its properties could not be evaluated.

In Comparative Examples 23 to 31 in Table 2, the samples were produced by simulating ordinary or conventional production methods. Namely, the copper alloy falls within the scope of the invention in Table 1 (Alloy Nos. 1 and 2), and the other production conditions for these are within the preferred range similarly to Examples. However, differing from those in the above-mentioned Examples, the average cooling ratio to room temperature after the finish heat treatment or annealing is too low, or the reduction ratio in the final cold rolling is too low, or the time taken in each step before the final heat treatment or annealing at low temperature is too long, as in Table 2. Therefore, the average density of the atomic clusters according to the invention is too smaller, outside the scope of the invention, than that in Examples 1 and 5 in Table 2 for which the other conditions were the same as in Table 3.

In these Comparative Examples 23 to 31, the composition range is suitable and the other production conditions than the preferred production conditions for formation of the atomic clusters according to the invention fall within the preferred ranges as in Examples. Accordingly, it may be considered that the formation of coarse compounds containing Ni such as oxides containing Ni, crystallized products containing Ni and precipitated products containing Ni could be inhibited and the amount of relatively large but fine compounds containing Ni or the like and the amount of solute Ni could be secured. However, in these Comparative Examples, the average density of the atomic clusters according to the invention is too small, outside the scope of the invention, as in Table 3, and therefore, the resistance property of stress relaxation is extremely lower than that in Examples 1 and 5. Namely, in these Comparative Examples, the resistance property of stress relaxation in the direction perpendicular to the rolling direction is extremely inferior to that in Examples. In addition, the difference between the stress relaxation ratio in the direction perpendicular to the rolling direction and the stress relaxation ratio in the direction parallel to the rolling direction is large.

In Comparative Example 31 in Table 2, the temperature in the final heat treatment or annealing at low temperature is too low, and one is equivalent to that not processed for the final heat treatment or annealing at low temperature. Accordingly, the average density of the atomic clusters according to the invention is too smaller, outside the scope of the invention, than that in Example 5 in Table 2 for which the other conditions were the same as those in the Comparative Example, as in Table 3. As a result, in Comparative Example 31, the resistance property of stress relaxation is extremely lower and the difference between the stress relaxation ratio in the direction perpendicular to the rolling direction and the stress relaxation ratio in the direction parallel to the rolling direction is larger than that in Example 5.

The above results support the meanings of the ingredient composition of the copper alloy sheet of the invention, the structure thereof and further the preferred production condition for obtaining the structure, in producing a Cu—Ni—Sn—P alloy sheet which satisfies the resistance property of stress relaxation in the direction perpendicular to the rolling direction with little difference between the resistance property of stress relaxation in the perpendicular direction to the rolling direction and that in the parallel direction to the rolling direction and which is excellent in the other necessary properties as terminals and connectors.

TABLE 1

| | | Chemical Ingredient Composition of Copper Alloy sheet (remainder Cu) | | | | | | | | | |
|---|---|---|---|---|---|---|---|---|---|---|---|
| Sectioning | No. | Ni | Sn | P | Fe | Zn | Mn | Si | Mg | Group A elements # | Group B elements # |
| Examples | 1 | 1.4 | 0.5 | 0.09 | 0.01 | 0.02 | 0.01 | — | — | — | — |
| | 2 | 0.8 | 1.0 | 0.07 | 0.02 | 0.02 | — | — | — | — | — |
| | 3 | 0.1 | 1.0 | 0.07 | 0.02 | 0.01 | — | — | 0.01 | — | — |
| | 4 | 3.0 | 0.9 | 0.07 | 0.01 | 0.03 | — | 0.01 | — | — | — |
| | 5 | 0.8 | 0.01 | 0.08 | 0.2 | 0.01 | — | — | — | — | — |
| | 6 | 0.6 | 3.0 | 0.05 | 0.01 | — | 0.01 | — | 0.01 | — | — |

TABLE 1-continued

| Sectioning | No. | Chemical Ingredient Composition of Copper Alloy sheet (remainder Cu) | | | | | | | | | |
|---|---|---|---|---|---|---|---|---|---|---|---|
| | | Ni | Sn | P | Fe | Zn | Mn | Si | Mg | Group A elements # | Group B elements # |
| | 7 | 1.4 | 0.6 | 0.01 | 0.1 | 0.02 | — | 0.01 | 0.01 | — | — |
| | 8 | 1.4 | 0.7 | 0.3 | 0.02 | 0.03 | — | 0.01 | — | — | — |
| | 9 | 0.8 | 1.0 | 0.06 | 0.02 | 0.01 | 0.02 | — | — | 1.1 | — |
| | 10 | 0.9 | 1.0 | 0.07 | — | 0.02 | — | — | — | — | 0.3 |
| Comparative | 11 | 0.05 | 1.0 | 0.07 | 0.01 | 0.01 | — | 0.01 | 0.01 | — | — |
| Examples | 12 | 3.3 | 1.0 | 0.06 | 0.02 | 0.02 | — | — | 0.02 | — | — |
| | 13 | 0.8 | — | 0.07 | — | 0.02 | — | 0.01 | — | — | — |
| | 14 | 0.5 | 3.2 | 0.07 | 0.02 | — | 0.01 | — | — | — | — |
| | 15 | 0.8 | 1.1 | 0.005 | 0.01 | 0.03 | 0.01 | — | 0.01 | — | — |
| | 16 | 0.8 | 1.0 | 0.35 | 0.1 | — | — | — | — | — | — |

* — means lower than the detection limit.

* Other group A elements: total content of Ca, Zr, Ag, Cr, Cd, Be, Ti, Co, Au, Pt

* Other group B elements: total content of Hf, Th, Li, Na, K, Sr, Pd, W, S, C, Nb, Al, V, Y, Mo, Pb, In, Ga, Ge, As, Sb, Bi, Te, B, Misch metal

TABLE 2

| Sectioning | No. | Alloy No. Table 1 | Finish Heat Treatment of Annealing | | Final Cold Rolling | | |
|---|---|---|---|---|---|---|---|
| | | | Average Cooling Rate (° C./sec) | Time before Final Cold Rolling (min) | Reduction Ratio (%) | Time before Final Heat Treatment or Annealing (min) | Temperature in final heat treatment or annealing at low temperature |
| Examples | 1 | 1 | 300 | 40 | 75 | 30 | 350 |
| | 2 | 1 | 200 | 50 | 65 | 50 | 350 |
| | 3 | 1 | 300 | 60 | 75 | 20 | 350 |
| | 4 | 1 | 300 | 40 | 70 | 60 | 350 |
| | 5 | 2 | 300 | 40 | 70 | 20 | 350 |
| | 6 | 2 | 200 | 40 | 60 | 40 | 400 |
| | 7 | 2 | 200 | 60 | 65 | 50 | 350 |
| | 8 | 2 | 100 | 30 | 60 | 60 | 350 |
| | 9 | 3 | 200 | 40 | 75 | 40 | 400 |
| | 10 | 4 | 200 | 40 | 65 | 40 | 350 |
| | 11 | 5 | 200 | 40 | 75 | 40 | 350 |
| | 12 | 6 | 100 | 40 | 60 | 40 | 350 |
| | 13 | 7 | 200 | 40 | 70 | 40 | 350 |
| | 14 | 8 | 200 | 40 | 60 | 40 | 350 |
| | 15 | 9 | 100 | 40 | 70 | 40 | 350 |
| | 16 | 10 | 200 | 40 | 70 | 40 | 350 |
| Comparative | 17 | 11 | 200 | 40 | 75 | 40 | 350 |
| Examples | 18 | 12 | 200 | 40 | 60 | 40 | 350 |
| | 19 | 13 | 300 | 40 | 75 | 40 | 350 |
| | 20 | 14 | 200 | 50 | 60 | 40 | 400 |
| | 21 | 15 | 200 | 40 | 70 | 40 | 350 |
| | 22 | 16 | — | — | — | — | — |
| | 23 | 1 | 80 | 40 | 75 | 30 | 350 |
| | 24 | 1 | 300 | 70 | 75 | 30 | 350 |
| | 25 | 1 | 300 | 40 | 55 | 30 | 350 |
| | 26 | 1 | 300 | 40 | 75 | 80 | 350 |
| | 27 | 2 | 50 | 40 | 70 | 40 | 350 |
| | 28 | 2 | 300 | 70 | 70 | 40 | 350 |
| | 29 | 2 | 300 | 40 | 50 | 40 | 350 |
| | 30 | 2 | 300 | 40 | 70 | 70 | 350 |
| | 31 | 2 | 300 | 40 | 70 | 30 | 80 |

TABLE 3

| | | | Properties of Copper Alloy sheet | | | | | | | |
|---|---|---|---|---|---|---|---|---|---|---|
| | | | Structure | | | | | | | |
| Sectioning | No. | Alloy No. Table 1 | Average density of Atomic Clusters ($\times 10^5/\mu m^3$) | Average Grain Size (μm) | Electric conductivity (%, IACS) | Tensile Strength in perpendicular direction (MPa) | 0.2% yield strength in perpendicular direction (MPa) | Stress Relaxation Ratio | | |
| | | | | | | | | Perpendicular Direction (%) | Parallel Direction (%) | Difference (%) |
| Examples | 1 | 1 | 40 | 3.8 | 38 | 550 | 540 | 6 | 4 | 2 |
| | 2 | 1 | 28 | 4.0 | 40 | 535 | 520 | 8 | 6 | 2 |
| | 3 | 1 | 34 | 3.8 | 38 | 550 | 535 | 7 | 5 | 2 |
| | 4 | 1 | 31 | 3.7 | 39 | 545 | 530 | 7 | 5 | 2 |
| | 5 | 2 | 38 | 3.6 | 34 | 570 | 555 | 6 | 4 | 2 |
| | 6 | 2 | 27 | 3.8 | 35 | 555 | 540 | 8 | 6 | 2 |
| | 7 | 2 | 25 | 4.0 | 34 | 560 | 550 | 8 | 6 | 2 |
| | 8 | 2 | 20 | 4.3 | 36 | 550 | 540 | 9 | 6 | 3 |
| | 9 | 3 | 6 | 3.9 | 41 | 540 | 515 | 9 | 6 | 3 |
| | 10 | 4 | 30 | 3.9 | 33 | 580 | 565 | 7 | 5 | 2 |
| | 11 | 5 | 35 | 4.0 | 45 | 525 | 505 | 9 | 6 | 3 |
| | 12 | 6 | 18 | 3.6 | 31 | 645 | 625 | 8 | 5 | 3 |
| | 13 | 7 | 12 | 3.8 | 41 | 540 | 520 | 9 | 6 | 3 |
| | 14 | 8 | 38 | 3.6 | 32 | 620 | 600 | 7 | 5 | 2 |
| | 15 | 9 | 34 | 3.8 | 30 | 650 | 630 | 8 | 6 | 2 |
| | 16 | 10 | 35 | 3.6 | 30 | 645 | 625 | 8 | 6 | 2 |
| Comparative Examples | 17 | 11 | 3 | 4.0 | 41 | 515 | 495 | 12 | 8 | 4 |
| | 18 | 12 | 29 | 3.8 | 29 | 575 | 560 | 8 | 5 | 3 |
| | 19 | 13 | 34 | 4.1 | 45 | 500 | 485 | 10 | 7 | 3 |
| | 20 | 14 | 15 | 3.6 | 28 | 620 | 600 | 9 | 6 | 3 |
| | 21 | 15 | 4 | 3.7 | 41 | 510 | 495 | 11 | 7 | 4 |
| | 22 | 16 | — | — | — | — | — | — | — | — |
| | 23 | 1 | 4 | 4.2 | 40 | 540 | 520 | 11 | 7 | 4 |
| | 24 | 1 | 3 | 3.8 | 38 | 550 | 535 | 12 | 8 | 4 |
| | 25 | 1 | 4 | 3.6 | 40 | 525 | 510 | 10 | 6 | 4 |
| | 26 | 1 | 3 | 3.7 | 38 | 550 | 530 | 13 | 9 | 4 |
| | 27 | 2 | 2 | 4.8 | 35 | 560 | 540 | 14 | 9 | 5 |
| | 28 | 2 | 3 | 3.6 | 34 | 565 | 550 | 12 | 8 | 4 |
| | 29 | 2 | 2 | 3.5 | 35 | 540 | 525 | 14 | 10 | 4 |
| | 30 | 2 | 3 | 3.6 | 34 | 570 | 550 | 12 | 8 | 4 |
| | 31 | 2 | 1 | 3.5 | 33 | 570 | 555 | 16 | 11 | 5 |

While the invention has been described in detail and with reference to specific embodiments thereof, it will be apparent to one skilled in the art that various changes and modifications can be made therein without departing from the spirit and scope thereof.

This application is based on Japanese patent application No. 2008-021355 filed on Jan. 31, 2008, the entire contents thereof being hereby incorporated by reference.

INDUSTRIAL APPLICABILITY

As described in the above, according to the invention, there is provided a Cu—Ni—Sn—P alloy sheet which satisfies the resistance property of stress relaxation in the direction perpendicular to the rolling direction with little difference between the resistance property of stress relaxation in the perpendicular direction to the rolling direction and that in the parallel direction to the rolling direction and which is excellent in the other necessary properties as terminals and connectors. As a result, it is favorable especially for connecting parts such as automotive terminals and connectors.

The invention claimed is:

1. A copper alloy sheet, comprising:

Ni in 0.1 to 3.0 mass %;

Sn in 0.01 to 3.0 mass %;

P in 0.01 to 0.3 mass %; and a remainder comprising copper and an inevitable impurity, wherein the copper alloy sheet has a stress relaxation ratio in the direction perpendicular to the rolling direction of less than 10%, the difference between the stress relaxation ratio in the direction parallel to the rolling direction and the stress relaxation ratio in the direction perpendicular to the rolling direction is 3% or less, and the copper alloy sheet comprises an atomic cluster which is detected with a three-dimensional atom probe field ion microscope, and the atomic cluster comprises at least one of a Ni atom or a P atom, wherein:

a distance between the Ni atom or P atom and an Ni atom or P atom adjacent to the Ni atom or P atom is 0.90 nm or less;

a total number of Cu, Ni, and P atoms in the atomic cluster is 15 or more and less than 100; and an average density of atomic clusters is $5\times10^5/\mu m^3$ or more.

2. The copper alloy sheet according to claim 1, which further comprises at least one element selected from the group consisting of Fe in more than 0 to 0.5 mass % or less, Zn in more than 0 to 1 mass % or less, Mn in more than 0 to 0.1 mass % or less, Si in more than 0 to 0.1 mass % or less, and Mg in more than 0 to 0.3 mass % or less.

3. The copper alloy sheet according to claim 2, which further comprises Ca, Zr, Ag, Cr, Cd, Be, Ti, Co, Au, and Pt in a total amount of 1.0 mass % or less.

4. The copper alloy sheet according to claim 3, which further comprises Hf, Th, Li, Na, K, Sr, Pd, W, S, C, Nb, Al, V, Y, Mo, Pb, In, Ga, Ge, As, Sb, Bi, Te, B, and Misch metal in a total amount of 0.1 mass % or less.

5. The copper alloy sheet according to claim 2, which further comprises Hf, Th, Li, Na, K, Sr, Pd, W, S, C, Nb, Al, V, Y, Mo, Pb, In, Ga, Ge, As, Sb, Bi, Te, B, and Misch metal in a total amount of 0.1 mass % or less.

6. The copper alloy sheet according to claim 1, which further comprises Ca, Zr, Ag, Cr, Cd, Be, Ti, Co, Au, and Pt in a total amount of 1.0 mass % or less.

7. The copper alloy sheet according to claim 6, which further comprises Hf, Th, Li, Na, K, Sr, Pd, W, S, C, Nb, Al, V, Y, Mo, Pb, In, Ga, Ge, As, Sb, Bi, Te, B, and Misch metal in a total amount of 0.1 mass % or less.

8. The copper alloy sheet according to claim 1, which further comprises Hf, Th, Li, Na, K, Sr, Pd, W, S, C, Nb, Al, V, Y, Mo, Pb, In, Ga, Ge, As, Sb, Bi, Te, B, and Misch metal in a total amount of 0.1 mass % or less.

9. A copper alloy sheet according to claim 1, wherein the copper alloy sheet has a stress relaxation ratio in the direction perpendicular to the rolling direction from 6% to less than 10%.

10. A copper alloy sheet, comprising:

Ni in 0.1 to 3.0 mass %;

Sn in 0.01 to 3.0 mass %;

P in 0.01 to 0.3 mass %; and a remainder comprising copper and an inevitable impurity, wherein the copper alloy sheet has a stress relaxation ratio in the direction perpendicular to the rolling direction from 6% to less than 10%, the difference between the stress relaxation ratio in the direction parallel to the rolling direction and the stress relaxation ratio in the direction perpendicular to the rolling direction is 3% or less, and the copper alloy sheet comprises an atomic cluster which is with a three-dimensional atom probe field ion microscope, and the atomic cluster comprises at least one of a Ni atom or a P atom, wherein:

a distance between the Ni atom or P atom and an Ni atom or P atom adjacent to the Ni atom or P atom is 0.90 nm or less;

a total number of Cu, Ni, and P atoms in the atomic cluster is 15 or more and less than 100; and an average density of atomic clusters is $5\times10^5/\mu m^3$ or more.

11. The copper alloy sheet according to claim 10, which further comprises at least one element selected from the group consisting of Fe in more than 0 to 0.5 mass % or less, Zn in more than 0 to 1 mass % or less, Mn in more than 0 to 0.1 mass % or less, Si in more than 0 to 0.1 mass % or less, and Mg in more than 0 to 0.3 mass % or less.

12. The copper alloy sheet according to claim 10, which further comprises Ca, Zr, Ag, Cr, Cd, Be, Ti, Co, Au, and Pt in a total amount of 1.0 mass % or less.

13. The copper alloy sheet according to claim 10, which further comprises Hf, Th, Li, Na, K, Sr, Pd, W, S, C, Nb, Al, V, Y, Mo, Pb, In, Ga, Ge, As, Sb, Bi, Te, B, and Misch metal in a total amount of 0.1 mass % or less.

14. A copper alloy sheet according to claim 10, wherein the copper alloy sheet has a stress relaxation ratio in the direction perpendicular to the rolling direction from 6% to less than 9%.

* * * * *